United States Patent [19]

May

[11] 3,973,282

[45] Aug. 10, 1976

[54] WATER BED LINER HOLDER

[76] Inventor: Marvin I. May, 960 Second St., Hermosa Beach, Calif. 90254

[22] Filed: Oct. 15, 1975

[21] Appl. No.: 622,677

[52] U.S. Cl. ..... 5/370; 5/317 R
[51] Int. Cl.[2] ..... A47C 27/08
[58] Field of Search ..... 5/320, 322, 345 R, 348 R, 5/ 348 WB, 349, 350; 297/452; 219/217

[56] References Cited

UNITED STATES PATENTS

| | | | |
|---|---|---|---|
| 773,828 | 11/1904 | Titus | 5/348 WB |
| 2,849,729 | 9/1958 | Goodey et al. | 5/345 X |
| 3,126,229 | 3/1964 | Dickerson | 297/452 UX |
| 3,585,356 | 6/1971 | Hall | 5/348 WB |
| 3,838,470 | 10/1974 | May | 5/348 WB |

*Primary Examiner*—Paul R. Gilliam
*Assistant Examiner*—Andrew M. Calvert
*Attorney, Agent, or Firm*—Romney Schaap Golant Scillieri & Ashen

[57] ABSTRACT

A liner restrainer which in a first embodiment comprises an extruded synthetic resin clip having a leg portion for retaining the clip in position relative to the interior surfaces of a water bed frame, a central portion bowed to provide a storage space and a spring bias and a head portion for bearing against the frame and a water bed liner to hold the liner in place. In a second embodiment, the liner restrainer comprises two extruded elements, a clip section and a rail section, which function like the first embodiment to hold the liner; each embodiment is inexpensive and very easy to use so that a water bed can be assembled very quickly and easily. Readjustment of the liner can also be accomplished easily and quickly.

13 Claims, 9 Drawing Figures

WATER BED LINER HOLDER

BACKGROUND OF THE INVENTION

1. Field of the Invention

The present invention relates to a clip type holder and, more particularly, to a holder or restrainer for the synthetic resin liner of a water bed for keeping the liner in a preselected position within the water bed frame. Among the restrainer's many advantages are its ease of use and its low cost.

2. Description of the Prior Art

With the wide-spread popularity and usage of water beds, it has become apparent that a unique problem exists which if unchecked could cause sudden and substantial damage. An average king-size water bed holds up to 2,000 lbs. of water. Should the water mattress rupture, there is the likelihood of a substantial amount of water escaping to cause enormous water damage to other furniture as well as to the building structure.

In the short time since the water bed has achieved wide-spread popularity, various methods and devices have been developed to hold a plastic liner within a frame over which the water mattress is then placed. The liner is to act as a water reservoir should the mattress rupture, thereby containing the water within the bed frame.

Generally, the prior art attachment methods have included the placement of the ends of the liner between two complimentary elements which are snapped together. For example, capping strips have been developed to snap onto the uppermost edge of a frame with the plastic liner squeezed between the strip and the frame edge. Other strips have been developed to press into grooves cut along the interior lateral surfaces of the frame; again, the liner is supposed to be captured between the grooved frame surfaces and the inserted strip. Other prior art devices include tack strips which are nailed to the interior surfaces of the frame; once again, the liner is to be captured between the tack strip and the frame. Another prior art method is to simply tack the upper edge of the liner to the interior lateral surfaces of the frame.

A more recent prior art device used for liner retention is shaped like a match cover and is tacked or nailed to the interior lateral surfaces of a frame. The liner is then placed inside the cover for retention.

Generally, all of the prior art devices suffer from one or more major disadvantages. Among these include such functional problems as the inability to restrain the liner in use; that is, the liner slips away from the device which is supposed to hold it. Another problem is the great difficulty encountered in installing the prior art device to the bed frame and/or in attaching the liner and the device together. Some prior art devices have been found to be exceedingly difficult to pry open or snap shut. Still other devices and attachment methods permanently damage the liner so that the liner must be discarded if the bed is moved; others damage the liner so badly during installation that it can no longer perform its water-containing function.

Other problems in the prior art include matters of aesthetics. For example, some devices require an exact fitting of the liner; if the fit is not exact, the edge of the liner will become an unsightly protrusion. Trimming the liner before installation introduces difficult tolerance problems.

Of course it is always commercially desirable to have a product that is relatively inexpensive, simply constructed and yet reliable in operation.

SUMMARY OF THE INVENTION

The above prior art problems have now been overcome by the present invention which provides a liner restrainer to be described herein, the restrainer comprising a resilient element having a bottom portion for positioning the restrainer, a top portion biased to apply a force against the liner and the frame, and a central portion outwardly extending to provide a space between the central portion and the frame for liner storage.

It is an aim of the present invention to provide a water bed liner restrainer or holder which is inexpensive and yet reliable and very simply constructed.

Another aspect of the present invention is to provide a water bed liner restrainer which is easy to use and which is self-biasing, the restrainer having an upper portion which can easily be moved away from the bed frame by an assembler's fingers to enable the tucking of a plastic liner. The liner restrainer can be attached or connected to the frame at any safe height easily and quickly.

Another object of the present invention is to provide a water bed liner holder which allows for the storage of excess liner so that the fit of the liner is not a critical factor. Further, when in use the liner completely covers the holder so as to be cosmetically acceptable. At the same time, the holder allows for the retucking or readjustment of the liner without damage to the liner.

Yet another aim of the present invention is to provide a holder for a water bed liner which may be attached to the frame in any one of a number of ways, which is usable with any type of water bed design and does not interfere with the upper ledge or portion of the frame so that esthetically the frame is not disturbed. In addition, the inventive holder allows its use with other accessories such as the insert described in my earlier U.S. Pat. No. 3,838,470. By using my earlier disclosed insert and the holder described herein, a water bed may be taken apart or set up in a matter of minutes.

Yet another aspect of the present invention is to provide a liner restrainer which is self biasing and which uses the pressure inherent in the water bed mattress to keep the liner in its preselected position even when part of the bed is being made up.

Other objects and advantages of the present invention will become evident upon reading the following description in conjunction with the accompanying drawings.

DESCRIPTION OF THE PREFERRED EMBODIMENTS

Figure 1:
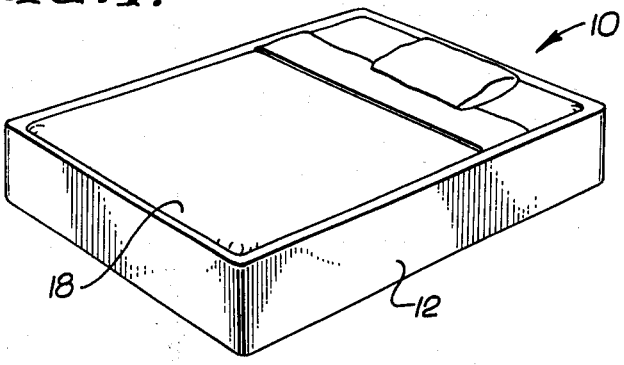
FIG. 1 is a perspective view of a water bed including a frame.

While the present invention is susceptible of various modifications and alternative constructions, illustrative embodiments are shown in the drawing and will herein be described in detail. It should be understood, however, that it is not the intention to limit the invention to the particular forms disclosed, but, on the contrary, the intention is to cover all modifications, equivalencies and alternative constructions falling within the spirit and scope of the invention as expressed in the appended claims.

Figure 2A:
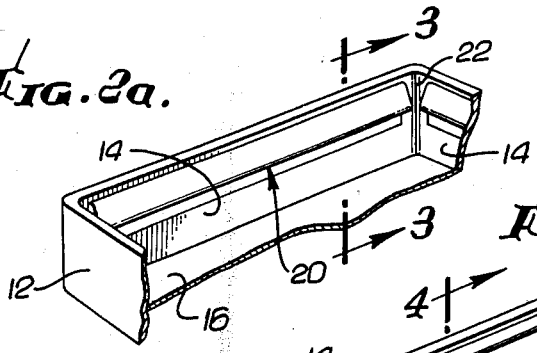
FIG. 2*a* is an enlarged perspective view of a portion of the water bed frame shown in FIG. 1 illustrating an embodiment of the present invention.

Referring now to FIGS. 1 and 2, there is illustrated a water bed 10 having a rectangularly shaped frame 12 having interior lateral surfaces or perimeter 14 and a bottom member 16. Located on top of the bottom member 16 and within the perimeter is a water-filled mattress 18.

Referring again to FIG. 2, there is illustrated the rather simplistic construction and manner in which the inventive liner restrainer holder is attached to the frame. In more detail, the holder 20 is in the form of an elongated clip shown attached to the interior surfaces 14, extending substantially the length of each side of the perimeter and coming within about an inch and a half of each of the corners of the perimeter such as corner 22.

As shown, FIG. **2*b* illustrates another variation of the present invention and comprises a two piece liner restrainer having a clip section 24 to which is mated a rail section 26.** As can be seen, the rail extends along substantially the length of a side of the perimeter while being supported by three spaced clip portions.

There are numerous advantages of the present invention including the fact that it is very inexpensive and may be easily used. The inventive holder includes a self-biasing feature and has room for the storage of excessive liner so that the liner dimensions are no longer a critical factor to be considered when setting up a water bed.

Figure 3:
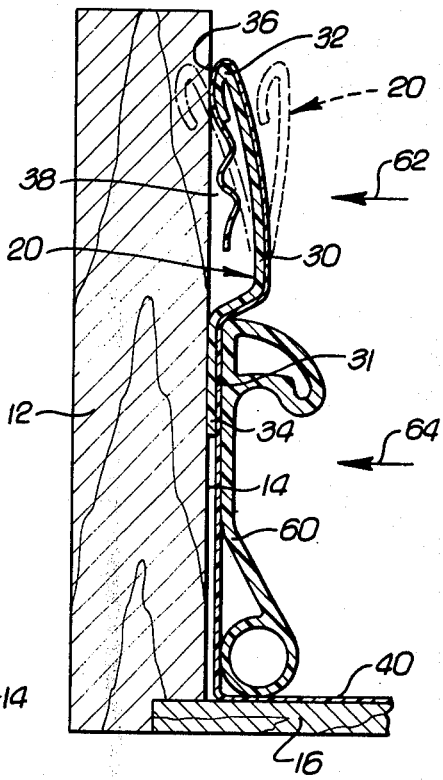
FIG. 3 is an enlarged elevational sectional view taken along line 3—3 of FIG. 2*a* illustrating the inventive liner holder in use.

Referring to FIG. 3, the clip 20 is shown in much greater detail. The clip includes three main portions, a base or center portion 30, an upper or head portion 32 and a lower or leg portion 34. The leg portion 34, as shown in FIG. 3 and as will be described below, is used to position and retain the clip in a preselected location by bearing against the interior lateral surfaces 14 of the frame.

The head portion 32 is designed with a slightly beveled top 36 to allow the insertion of the fingertips of an assembler. Inserting the fingers allows the performance of the dual operations of moving or flexing the head portion away from the frame (as shown in dotted line in FIG. 3) and the insertion of the ends of the liner 40 into a storage space 38. Integral with the head portion 36 and the leg portion 34 is the central portion 30 which is slightly bowed to form between itself and the surfaces 14 the storage space 38.

As can now be appreciated, the liner 40 may be installed simply by setting the main portion of the liner or the bottom 16 of the frame with the edges turned upwardly along the surfaces 14, along the contours of the clip 20 and around the head portion 32 into the space 38. Thus, the clip is completely covered. The initial set up or a readjustment or retucking to make the liner more taut can easily be accomplished by simply moving one's fingers downwardly along the beveled surface 36 of the clip so as to "stuff" the liner into the space 38. Because of the design of the clip and the resiliency of the clip material, not only does the center portion 30 provide a storage space but it also acts as a spring to provide a self-biasing force to automatically return itself to the position shown in FIG. 3 and press the head portion against the frame, thereby locking the liner in place.

It has been found that a clip of rigid polyvinylchloride material having a thickness of approximately 0.050 inches provides sufficient resiliency and works exceedingly well. Other preferable dimensions will be provided hereinbelow.

Figure 5:
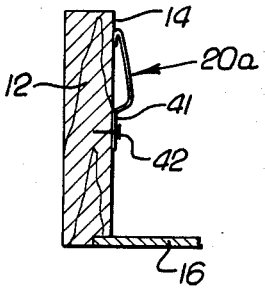
FIG. 5 is a diagrammatic elevational sectional view similar to FIG. 3 of a water bed frame and holder and illustrating one manner of attaching the liner holder to the frame.
Figure 6:
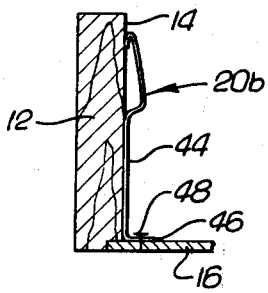
FIG. 6 is a diagrammatic elevational sectional view of a water bed frame and holder and illustrating another manner of attaching the holder to the frame.

Referring now to FIGS. 5–8, there is illustrated four clip or holder variations. In each FIGURE the clip is illustrated in position against the interior surface 14 of the frame 12. In FIG. 5, the leg or the lower portion 41 of the clip **20*a* is placed flatly against the vertical interior surface and fastened by any suitable device such as a nail, screw or staple 42. In FIG. 6, the leg portion 44 of the clip 20*b* is extended and bent at right angles to form a horizontal foot 46 which in turn is fastened to the bottom member 16 of the frame by a tack 48.**

Figure 7:
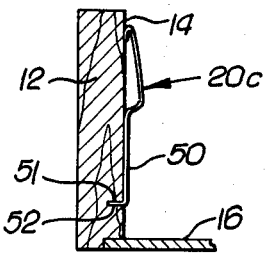
FIGS. 7 and 8 are diagrammatic elevational sectional views of frames and holders illustrating still other variations of attachment of the holder to the frames.
Figure 8:
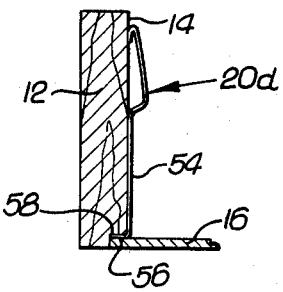

In FIG. 7, the leg portion 50 of the clip **20*c* is bent inwardly at a 90° angle to form a foot 51 which is received by a groove 52 in a press-fit engagement. In FIG. 8, the leg 54 of the clip 20*d* is also extended and bent at right angles to form a horizontal foot 56 which is received in a recess 58** between the vertical portion and the bottom member of the frame.

As can be readily seen, none of the attachment variations disclosed relative to FIGS. 5–8 interfere with the securing of the liner; the liner is not mutilated, torn or tacked in any way nor excessively stretched or distorted.

Referring back to FIG. 3, still another variation is illustrated for retaining the clip 20 in place. Abutting the leg portion 34 is an insert 60 which is described fully in my earlier U.S. Pat. No. 3,838,470 and which is incorporated herein by reference. The insert is used to restrain the bedding of the water bed. No fastener is needed because when the mattress is filled with water there will be a substantially outwardly directed pressure (illustrated by the arrows 62 and 64) applied against both the insert 60 as well as the clip 20. This pressure and the support from the insert will insure that the clip will remain in the location selected for it.

The clip 20 is designed to be made as a single inexpensive extruded piece, preferably of synthetic resin; yet with the variations illustrated, a water bed designer has a great latitude without having to compromise. Nevertheless whichever variation is used, assembly of the bed may be done quickly and easily without special tools.

As mentioned above, FIGS. **2*b* and 4 illustrate another variation of a liner restrainer or holder which includes the clip section 24 and the rail section 26. The clip section 24 is comprised of its own lower portion 70, center portion 72 and upper portion 74. The lower portion 70 may be designed as previously discussed relative to FIGS. 3, 5, 6, 7 and 8 while the center portion 72 may be identical to the center portion 30 of the FIG. 3 embodiment. The upper portion 74 differs from the FIG. 3 embodiment in that is geometry is generally complemented by the inner surface 76 of the rail 26 so that the rail may be snapped on or slidably engaged with the upper portion 74. As previously explained, it appears preferable to have three clip sections located along each of the four sides of a rectangularly shaped water bed frame. A rail is secured to each of the three clip sections on a side and extends substantially along an entire side. As with the head portion 32 of the clip 20, the outer surface 78** of the rail may be beveled to allow the insertion of the fingers of an assembler, thereby flexing the holder away from the frame. Slight forward movements of the fingers achieve the tucking of the liner around the holder.

Returning once again to the FIG. 3 embodiment, it has been found suitable that the clip have a height of about three inches, that the leg portion be about ⅝ inch in height, a sufficient distance to receive a screw or other fastener as shown in the FIG. 5 embodiment. The leg portion may also include a guide line 31 and prepunched holes to receive the fasteners.

In order to provide the self-biasing or spring-like action of the clip, the clip is designed to have the head portion 32 offset by approximately ⅛ inch. When the clip is unattached with nothing to bias the head portion it will be about ⅛ inch to the left as shown in an exaggerated fashion in phantom lines in FIG. 3. However, when the leg portion is aligned vertically with the interior surfaces of the frame, the frame biases the head portion. Thus, when the clips is connected to the frame, the head portion will be forced back about ⅛ inch. This places an overstress in the center portion of the clip which induces a biasing force in the clip against the interior surface 14. This biasing force will insure an adequate restraint on the liner once the liner is tucked into the space 38 and will also give the spring-back feature. Hence, once tucking is completed, the assembler need only remove his fingers and the clip will spring back against the liner.

Figure 2B:
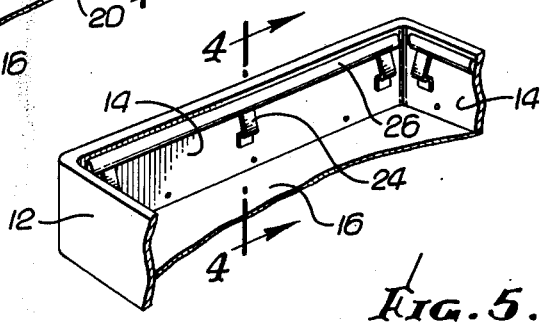
FIG. 2*b* is an enlarged perspective view of the frame shown in FIG. 1 illustrating another embodiment of the subject invention.
Figure 4:
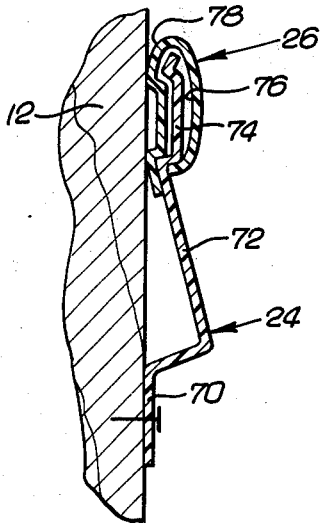
FIG. 4 is a diagrammatic elevational sectional view of another embodiment of the inventive liner holder taken along line 4—4 of FIG. 2*b;*

It is to be appreciated that the clip may be of metal as well as plastic; in the FIG. 2*b*, 4 embodiment the clip section may be a metal such as stainless or spring steel while the rail section may be plastic. Referring again to FIGS. 2*a* and 2*b*, it can now be appreciated that should an assembler desire to retuck or make more taut the liner no difficulty would arise even if the water mattress is in place. Since the water is easily movable, the assembler can work on a small portion of the liner restrainer, pulling it away from the frame without disturbing the remainder of the liner restrainer either on the same interior surface side or on any of the other interior surfaces of the frame. Of course once the assembler's fingers are removed, the self-biasing of the clip will cause the clip to move immediately into contact with the frame thereby holding the liner. In addition, the water mattress itself will resume its steady state condition in which it will also press outwardly against the interior surface of the frame adding an additional holding force to the liner as well as to bedding when the insert 60 is in place.

As mentioned in the first paragraph of the description various modifications are contemplated. For example, the holder may be formed in the shape of a bow (not shown) extending the vertical height of the frame or it may be shorter and extend downward from the top of the interior surface 14. The holder may also be bowed and have a laterally extending arm from the mid portion of its concave side to the frame to insure retention of the bowed shape even under the influence of the force created by the water mattress. Or alternatively, the holder can be generally straight and be positioned upright against the interior surface 14 of the frame or generally straight while having an arm extending between the upper portion of the holder and the frame for locating the upper portion of the holder away from the frame whereby the holder is obliquely disposed relative to the interior surface 14. In all of these variations, the holder may be inexpensively formed of an extruded synthetic resin or even of different types of paper products.

Of course it is understood that a portion of the interior surface of 14 may be recessed to accommodate or receive a holder so that a flush appearance of the liner may be achieved. This will improve the aesthetic appearance of the bed and prevent accidental contact with the top of the liner.

In operation, the liner restrainer provides for a quick and easy assembly of a water bed. Initially the frame is put together. The next step is to secure the clip or liner restrainer to the frame (the manner of attachment depending upon the leg portion design used). For example, nailing or stapling the clip as shown in FIG. 5 will take only a few moments; the extruded liner restrainer may be precut to the size of the frame and supplied by the frame manufacturer to the consumer. Next the liner is set within the frame and simply "tucked" around the clip until the liner is sufficiently taut. Tucking is achieved very easily by pulling back the resilient clip and rolling the liner with the fingertips into the space behind the center portion. The water mattress may then be positioned and filled with water. The final step is placing the bedding on top of the water mattress. If the embodiment shown in FIG. 3 is used, there will be no need to fasten the clip because the bedding insert 60 is inserted flush against the leg portion 34 to hold the clip in place.

It can now be understood that the clip holder may be used with any design or shape of frame, is inexpensive and simply constructed but yet highly reliable. Furthermore, the clip does not interfere with the aesthetic appearance of the frame or of the bedding as it is completely hidden when in use.

What is claimed is:

1. A liner holder to be attached to a frame of a water bed along its interior surface for restraining a waterproof liner placed within the interior of the frame, the liner forming with the frame a safety reservoir should the water bed rupture, the holder comprising:

a base of resilient material, said base being bowed to form with said frame a space for storage of a portion of said liner;

a leg portion connected to said base for bearing against said frame to help secure said holder in place; and a head portion connected to said base for bearing against said frame, with said liner being receivable between said head portion and said frame.

2. A holder as claimed in claim 1 wherein said base, said leg portion and said head portion are integral and said holder is elongated.

3. A holder as claimed in claim 2 wherein said head portion is beveled for receiving the fingers of an assembler who is able to flex said head portion away from said frame to introduce the ends of the liner into said space.

4. A holder as claimed in claim 2 wherein said head portion is placed in an overstressed condition when said holder is properly located relative to the frame for creating a biasing force against said frame.

5. A holder as claimed in clain 2 wherein said leg is vertically disposed.

6. A holder as claimed in claim 2 wherein said leg is horizontally disposed.

7. A holder as claimed in claim 2 including fastening means cooperating with said leg portion for connecting said frame and said holder.

8. A holder as claimed in claim 1 including an elongated rail having an inner surface.

9. A holder as claimed in claim 8 wherein said head portion and the inner surface of said rail are complementary whereby said rail may be easily engaged with said head portion.

10. A liner restrainer for use with a water bed liner to secure said liner in a desired position within a frame, said restrainer comprising:

a resilient element having a bottom portion for positioning said restrainer, a top portion biased to apply a force against said liner and said frame, and a central portion outwardly extending to provide a space between the central portion and said frame.

11. A liner restrainer as claimed in claim 10 wherein said element is approximately three inches in height and said top portion is offset horizontally approximately ⅛ inch when in an operative position relative to said frame whereby said bias is achieved by said offset.

12. A liner restrainer for use with a water bed liner to secure said liner in a desired position within a frame said restrainer comprising:

a flexible element having a bottom portion for locating said restrainer, a top portion over which said water bed liner is draped and a central portion integrally connecting said bottom and top portions, said element being placed generally upright along an interior surface of said frame which receives said liner within the frame while the edges of said liner extend parallel to a first side of said element loop over the top portion of said element and extend parallel to an opposite second side of said element whereby said liner edges are held in place within the frame.

13. A liner restrainer as claimed in claim 12 wherein said bottom portion includes a foot positioned at right angle to the remainder of said restrainer for being positioned along a bottom of said frame whereby a water bed mattress may be placed on said foot to position said restrainer adjacent a vertical portion of said frame.

* * * * *